United States Patent [19]

Gordon et al.

[11] Patent Number: 4,628,600

[45] Date of Patent: Dec. 16, 1986

[54] METHOD AND APPARATUS FOR PRODUCING ELECTRICAL HARNESSES HAVING MULTI-CONTACT CONNECTORS AND DISCRETE WIRES

[75] Inventors: Geoffery M. Gordon, Bideford, England; Edward J. Griffiths, Harrisburg, Pa.

[73] Assignee: AMP Incorporated, Harrisburg, Pa.

[21] Appl. No.: 693,956

[22] Filed: Jan. 23, 1985

[51] Int. Cl.[4] ..... H01R 43/04

[52] U.S. Cl. ..... 29/861; 29/749; 29/33 M; 81/9.51

[58] Field of Search ..... 29/33 M, 861, 566.3, 29/863, 865, 866, 857, 564, 41, 566.1; 81/9.51

[56] References Cited

U.S. PATENT DOCUMENTS

| | | | |
|---|---|---|---|
| 3,030,694 | 4/1962 | Kerstetter et al. | 29/33 |
| 3,086,282 | 4/1963 | Coates et al. | 81/9.51 X |
| 3,800,389 | 4/1974 | Brehm et al. | 29/ |
| 3,872,584 | 3/1975 | Chick et al. | 81/9.51 K |
| 4,409,734 | 10/1983 | Baraglia et al. | 29/749 X |
| 4,489,476 | 12/1984 | Over et al. | 29/564.4 |
| 4,493,147 | 1/1985 | Bakermans | 29/748 X |

FOREIGN PATENT DOCUMENTS

| | | | |
|---|---|---|---|
| 921777 | 3/1963 | United Kingdom | 29/857 |

*Primary Examiner*—Howard N. Goldberg
*Assistant Examiner*—Carl J. Arbes
*Attorney, Agent, or Firm*—Frederick W. Raring; Thomas G. Terrell

[57] ABSTRACT

Electrical harnesses comprising wires having a multi-contact connector on one end and discrete terminals on the free ends of the wires are produced by feeding individual wires, cutting a lead from the fed wire, moving the cut ends laterally to terminating zones, and attaching a terminal to one cut end and connecting the other cut end to a terminal in a multi-contact connector. The process is then repeated until wires have been connected to all of the terminals in the connector. An apparatus is also described for carrying out the method.

7 Claims, 12 Drawing Figures

METHOD AND APPARATUS FOR PRODUCING ELECTRICAL HARNESSES HAVING MULTI-CONTACT CONNECTORS AND DISCRETE WIRES

FIELD OF THE INVENTION

This invention relates to methods and apparatus for manufacturing electrical harnesses of the type comprising a multi-contact electrical connector, wires connected to the terminals in the connector, and discrete terminals on the other ends of the wires.

BACKGROUND OF THE INVENTION

A commonly used type of electrical harness comprises a multi-contact electrical connector having a plurality of terminals therein in side-by-side spaced-apart relationship. Wires are connected to the terminals in the connector and extend therefrom and may or may not have terminals crimped onto their other ends, that is the free ends of the wires. Usually, the terminals in the connector are of the type which have wire-receiving slots so that the wires can be connected to the terminals by merely inserting the wire ends into the slots in the terminals.

Harnesses of the type described above are ordinarily produced by machines of the general type shown, for example, in U.S. Pat. No. 4,136,440. Machines of this type have a wire insertion station at which all of the wires required for the connector are simultaneously inserted into the wire-receiving slots of the terminals in the connector. The wires may be fed by means of a shuttle which is movable towards the insertion station. In one type of machine, the shuttle pulls the wires from endless sources such as reels and delivers the ends to the insertion station at which they are connected to the terminals. The wires are then cut and may be stripped of their insulation if desired. Machines of this type usually do not have provision for crimping terminals onto the free ends of the wires and if terminals are required, the crimping operation is carried out in separate manufacturing steps.

Machines of the type shown in U.S. Pat. No. 4,136,440 and similar machines are in general highly satisfactory and are widely used in the electrical industry. They are, however, specialized machines and cannot be used for any purpose other then producing harnesses of the type being considered here. Therefore, a manufacturer requiring harnesses of the type under consideration must require a very large number of such harnesses to justify the purchase of a machine of the type shown in U.S. Pat. No. 4,136,440 or a similar machine. Furthermore, and as pointed out above, machines of this type do not have a means for connecting terminals to the free ends of the wires and if such an operation is required, an additional machine must be obtained to carry out the crimping operations.

The present invention is directed to the achievement of a method and apparatus for producing harnesses of the type described above which does not require specialized harness making machines as described in U.S. Pat. No. 4,136,440 but which can be carried out with any one of a number of known types of wire processing machines which are also capable of other manufacturing operations. The invention is further directed to the achievement of a method and apparatus which permits crimping of terminals onto the free ends of the wires.

THE INVENTION

In accordance with one aspect, the invention comprises a method of manufacturing an electrical harness of the type comprising a plurality of discrete wires, each wire having a first end and a second end. The second end of each wire is connected to a terminal in a multi-contact electrical connector which has a plurality of terminals therein in side-by-side relationship in a row. The method comprises the steps of feeding wire from an endless source along a wire feed path, cutting the wire in a cutting zone to produce a wire lead and first and second wire ends. The first wire end is the cut end of the wire extending from the endless source and the second cut end is the cut end of the lead wire. The second end is moved laterally of the feed path to a second wire connecting zone and in that zone, the second end is connected to one terminal in a multi-contact electrical connector in the second connecting zone. The feeding, cutting, moving and connecting steps are then repeated until wires have been connected to all of the terminals in the multi-contact connector.

In accordance with a further aspect of the invention, the first end is moved laterally after the cutting step to a first connecting zone and a discrete terminal is connected to the first end. In accordance with further aspects, the second ends of the wires are connected to terminals in a multi-contact connector by moving the second ends into wire-receiving slots in the terminals in the connector.

An apparatus embodiment of the invention is of the general type comprising a wire feeder for feeding wire from an endless source along a wire feed path. The apparatus has first and second normally opened and normally aligned wire clamps on the feed path. The first clamp being upstream, with regard to the direction of wire feed, from the second clamp. A wire cutter is located between the first and second clamps and first and second wire connecting assemblies are provided which are beside the wire feed path and proximate to the first and second wire clamps respectively. The first and second wire clamps are movable by clamp shifters from their aligned positions to positions which are proximate to the first and second wire terminating or connecting assemblies. The apparatus is characterized in that the second wire connecting assembly comprises an applicator for connecting wires, one at a time, to side-by-side terminals in an electrical connector. The second connecting assembly has a terminating zone, a connector support in the terminating zone, a ram which is reciprocable towards and away from a terminal in the terminating zone and towards and away from a connector which is on the connector support. A connector indexer is provided for advancing a connector on the connector support by a distance equal to the spacing between adjacent terminals in the connector. Actuating means are provided for actuating the wire feeder, for closing the wire clamps onto the fed wire, for closing the wire severing blades, and for thereafter actuating the clamp shifters. The actuator subsequently actuates the upstream and downstream terminating assemblies and thereafter causes opening of the downstream wire clamp only. After opening of the downstream wire clamp, the clamp shifters are again actuated to bring the clamps into alignment and the upstream clamp is opened. The indexer is also actuated to advance the connector in the terminating zone. The cycle is then repeated to connect wires to all of the terminals in the connector at which time the harness is completed.

THE DRAWING FIGURES

FIG. 1 is a perspective view of an electrical harness of the type produced in the practice of the invention.

FIGS. 1A–5 are perspective diagrammatic views which illustrate the essential steps in the practice of the method of the invention to produce a completed harness assembly.

FIG. 9 is a perspective view of an applicator for connecting wires to the terminals in a multi-contact electrical connector, this type of applicator being used on the apparatus of FIGS. 6–8.

Figure 11:
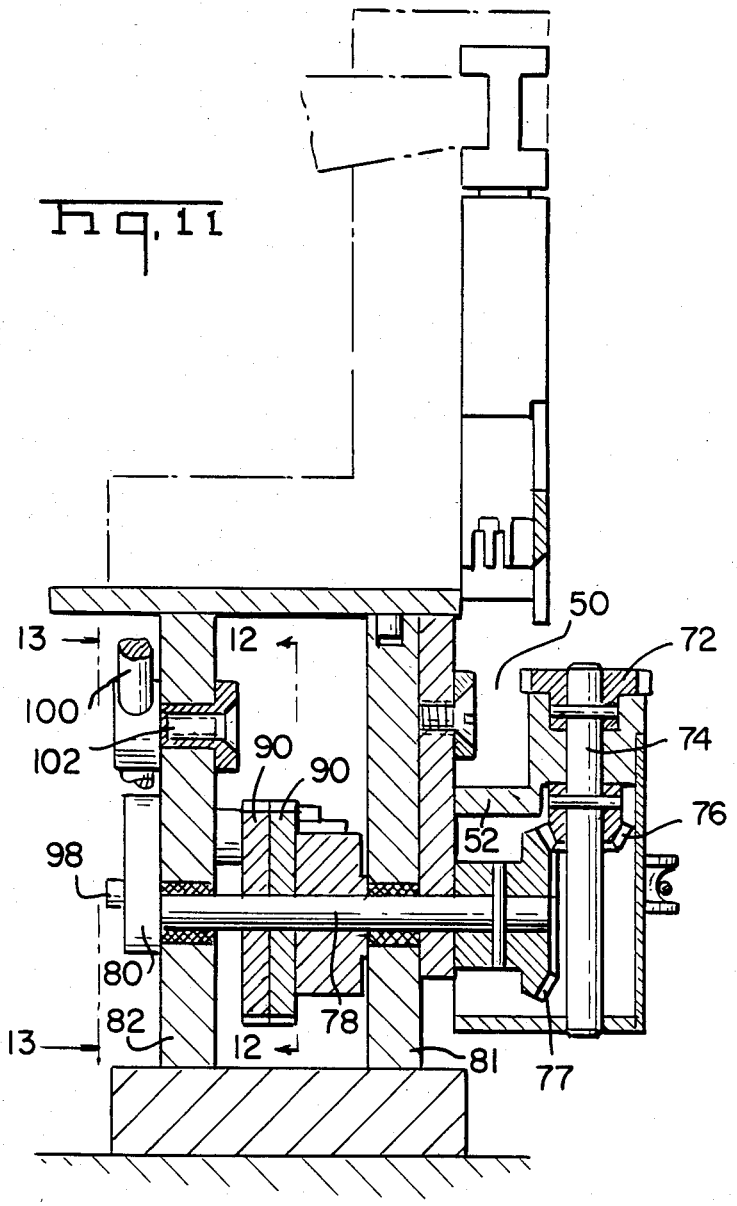
FIG. 11 is a view on an enlarged scale showing the central portion of the apparatus as viewed in FIG. 10, particularly showing the termination zone and features of the connector feeding means of the apparatus.
Figure 12:
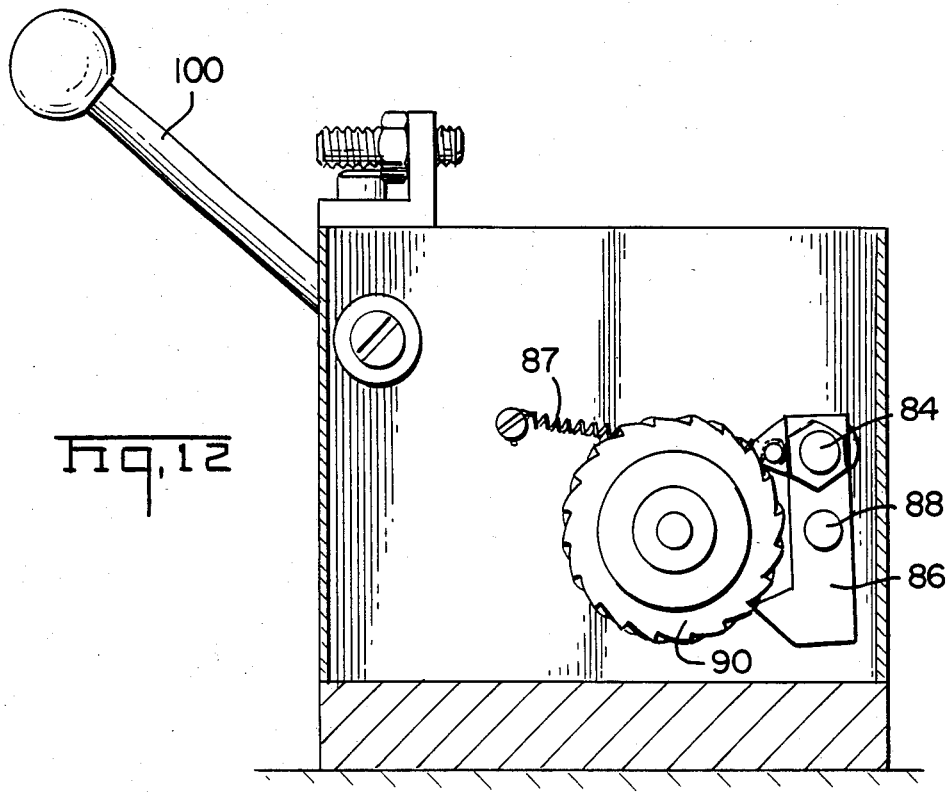
Figure 13:
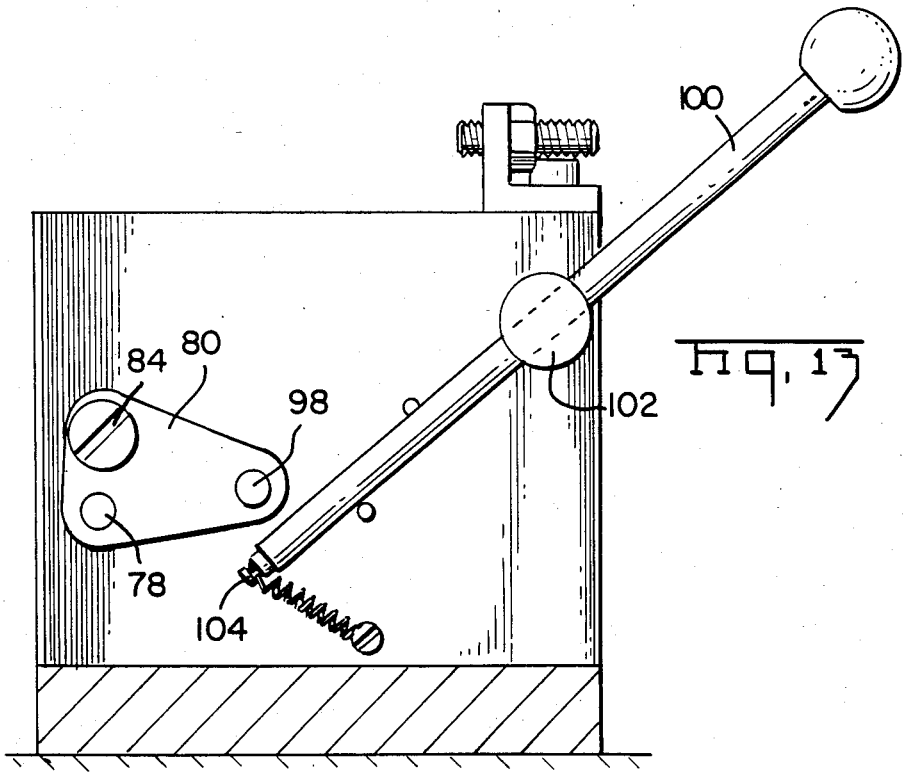

FIGS. 12 and 13 are views looking in the direction of the arrows 12—12 and 13—13 of FIG. 11 respectively.

THE DISCLOSED EMBODIMENT

The method of the invention will first be described in general terms with reference to FIGS. 1A–5 which show the essential steps which are followed in carrying out the method of the invention. Thereafter, one form of apparatus for the practice of the invention will be described in detail.

The practice of the invention results in production of electrical harnesses 2 (FIG. 1) of the type which comprise a plurality of discrete wires 4, each wire having a first end 6, and a second end 8. Terminals 10 are attached to the first ends 6 of the wires and the second ends 8 are connected to terminals in a multi-contact electrical connector 12. Connectors of the type shown at 12 are well known and are widely used in harness making operations. Connectors of this type have a plurality of side-by-side terminals therein, each terminal having a wire-receiving slot so that the ends 8 of the wires can be connected to the terminals by simply aligning the wires with the terminals and above the surface 13 of the connector and moving the wires downwardly and into the wire-receiving slots.

Figures 1, 1A:
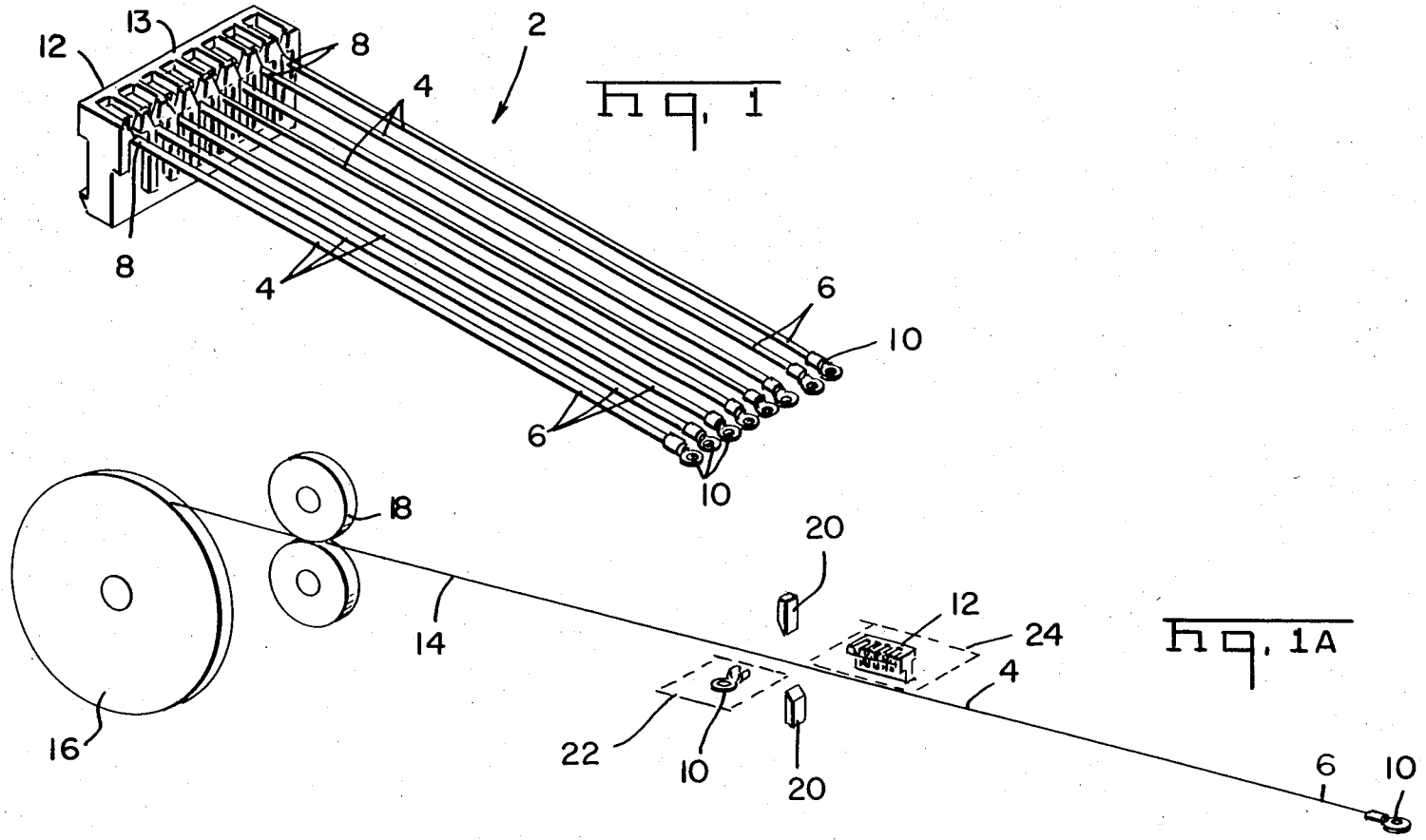
Figure 2:
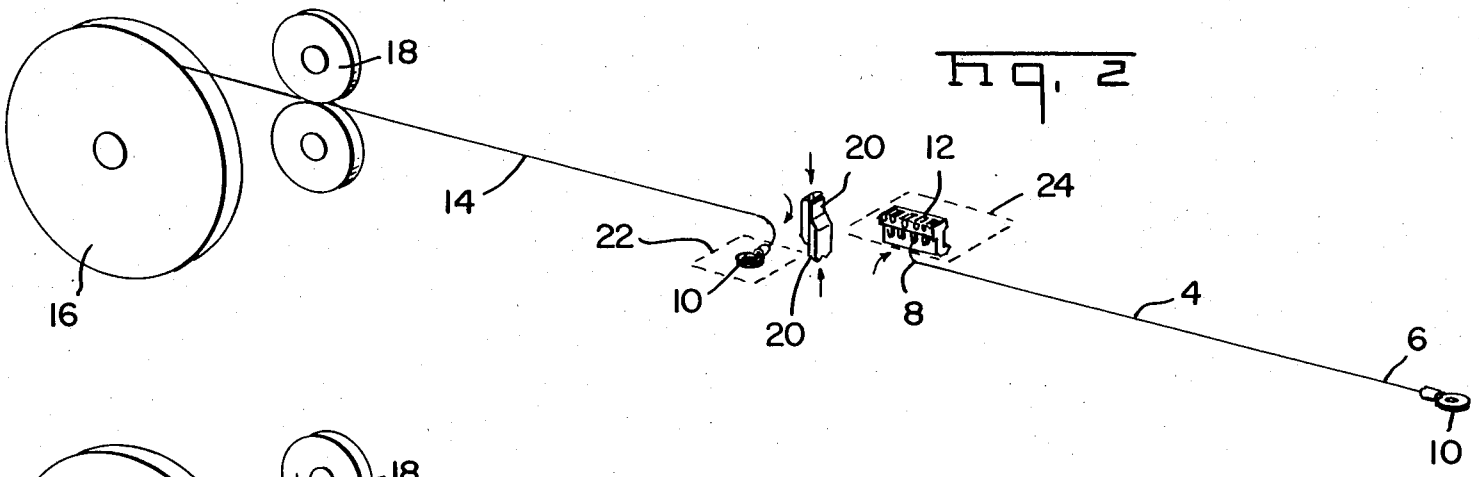

In the practice of the invention, wire 14 from a substantially endless source such as a barrel or reel 16 is fed by a suitable wire feeding means 18 along a predetermined wire feed path. In FIG. 1A, it is assumed that the wire 14 has been fed from the spool or reel 16 in preparation for an operating cycle. The wire feed path extends past a cutting means in the form of cutting blades 20. The cutting blades are then closed (FIG. 2) and the cut end 8 of the lead 4 is moved laterally to the right as viewed in FIG. 2 to a second wire connecting zone 24 in which a connector 12 is positioned. The cut end 8 is at this time connected to one of the terminals in this connector. The cut end of the wire 14 extending from the source is shifted leftwardly as viewed in FIG. 2 to a first wire connecting zone 22 in which it is connected to a terminal as shown in FIG. 2. Under some circumstances, it may be preferable to not connect a terminal to the leading end of the wire 14. The movement of the cut ends to the connecting zones 22, 24 is carried out by suitable wire clamps which are described below and which can take a variety of specific forms.

Figure 3:
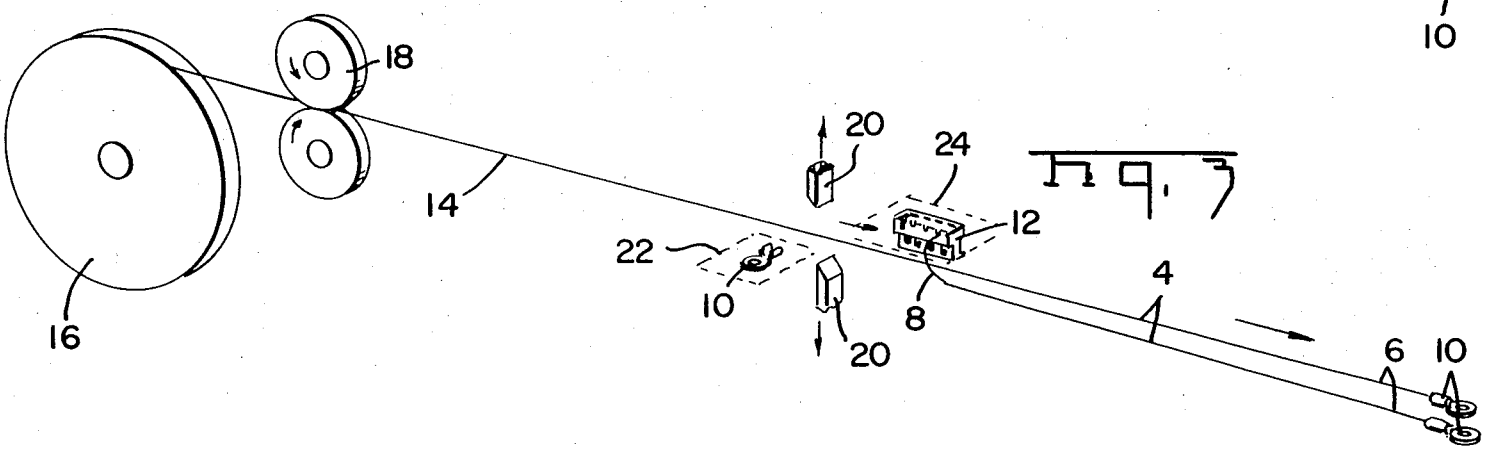
Figures 4, 5:
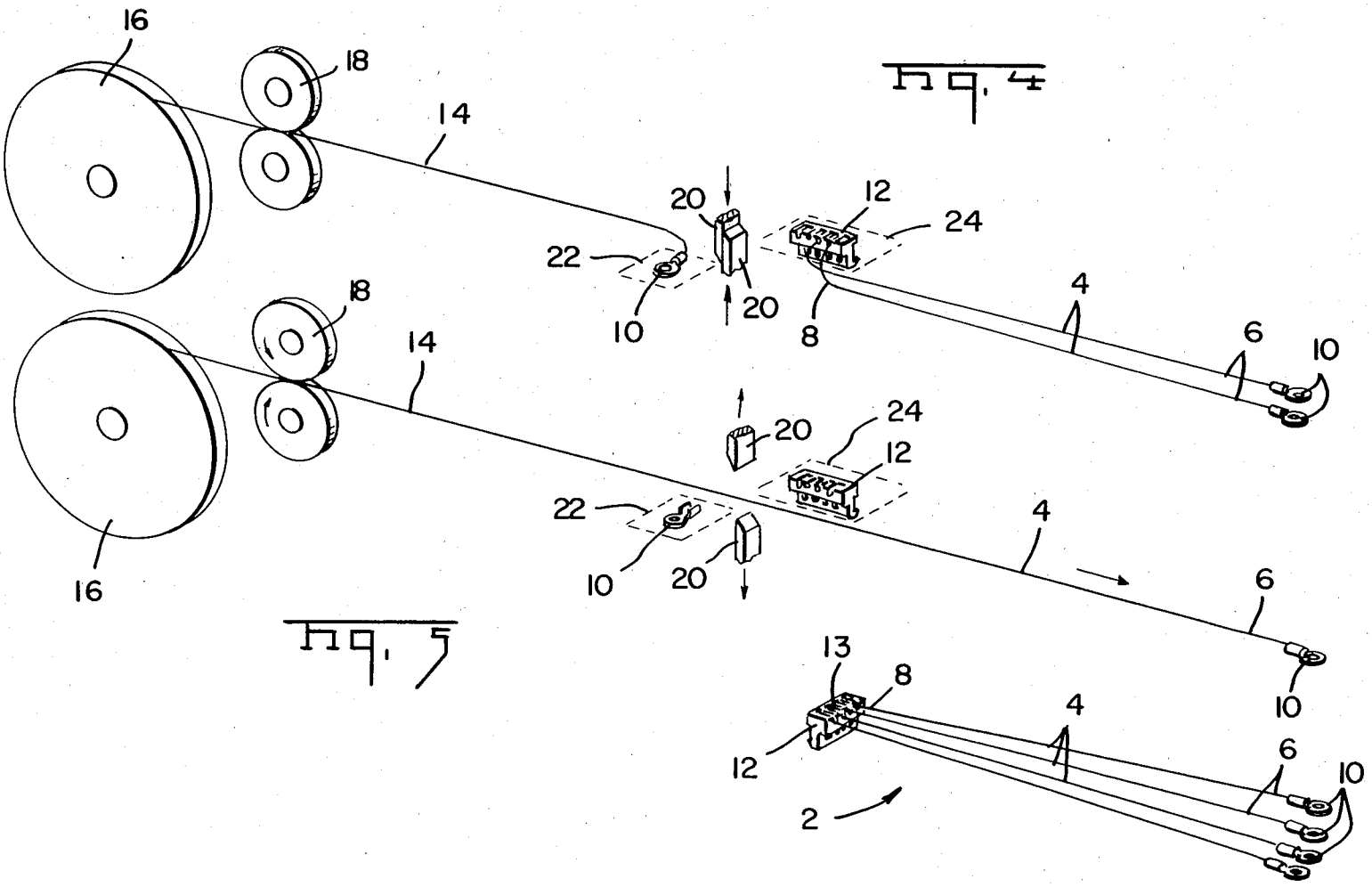

After the connecting or terminating steps of FIG. 2 have been carried out, the leading end of the wire 14 is returned to the wire feed path and the wire is again fed as shown in FIG. 3. Thereafter, the steps described above are repeatedly carried out until wires 4 have been connected to all of the terminals in the connector 12 as shown in FIG. 5. The finished harness is then ejected and a new connector 12 is fed to the connecting zone 24.

The direction of wire feed in FIGS. 1A–5 is from left to right and the connecting zone 24 can therefore be thought of as the downstream connecting zone with reference to the cutting means 20 and the connecting zone 22 can be referred to as the upstream connecting station or connecting zone.

It will be apparent from the foregoing that the method of the invention requires a relatively simple series of steps which are carried out repetitively until wires have been connected to all of the terminals in the connector 12. The method can be carried out with a relatively simple apparatus constructed and designed specifically to produce harnesses in accordance with the invention. The method of the invention can also be carried out with known types of machines which are designed primarily to produce electrical leads and which heretofore have not been used for purposes other than the production of electrical leads. For example, U.S. Pat. Nos. 3,030,694, 3,019,679, 3800,389, and 4,489,476 all show machines which, with modification, might be used to practice the method of the present invention. Furthermore, in addition to the machines shown in the above identified U.S. Patents, there are other commercially available lead-making machines which can also be used. In general, the more recently designed machines of this type are preferable for the practice of the invention for the reason that the newer machines are more readily modified for the reason that they are controlled by electronic devices such as microprocessors rather than by purely mechanical means such as cams. U.S. Pat. No. 4,489,476 for example shows a modern lead-making machine which is highly versatile and which can be adapted to the practice of the present invention.

Figure 6:
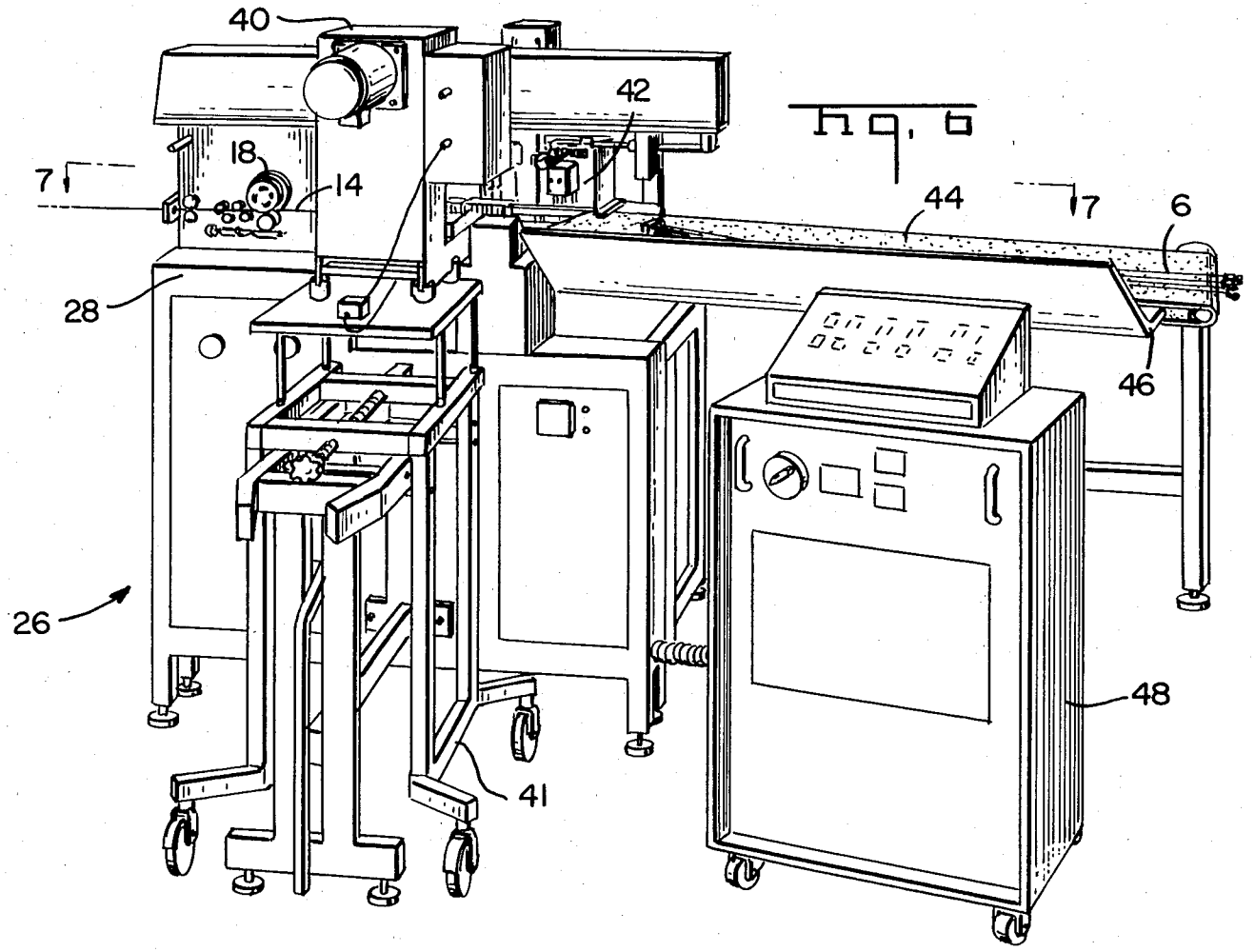
FIG. 6 is a perspective view of one form of apparatus for practicing the invention.
Figure 7:
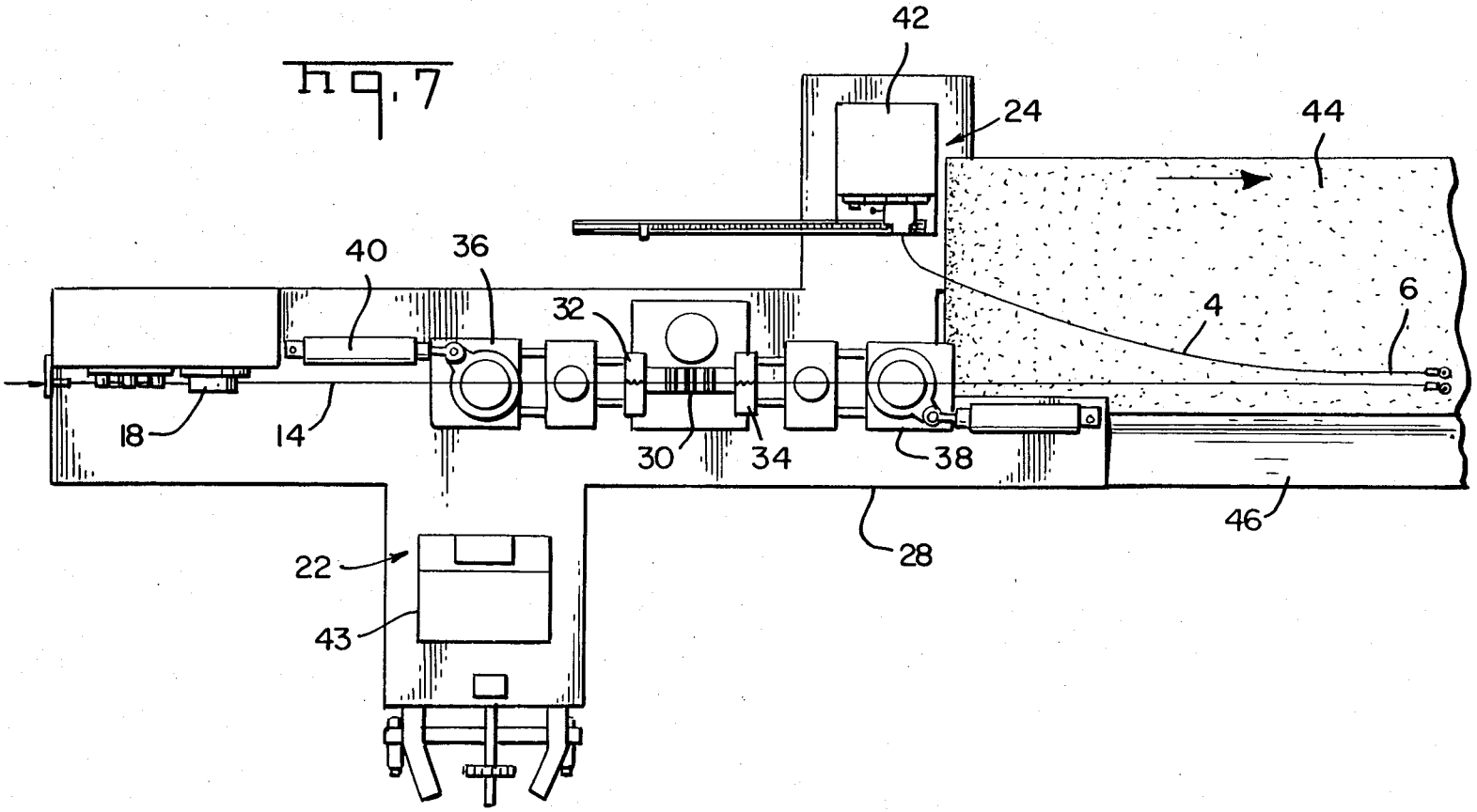
FIG. 7 is a view looking in the direction of the arrows 7—7 of FIG. 6.
Figure 8:
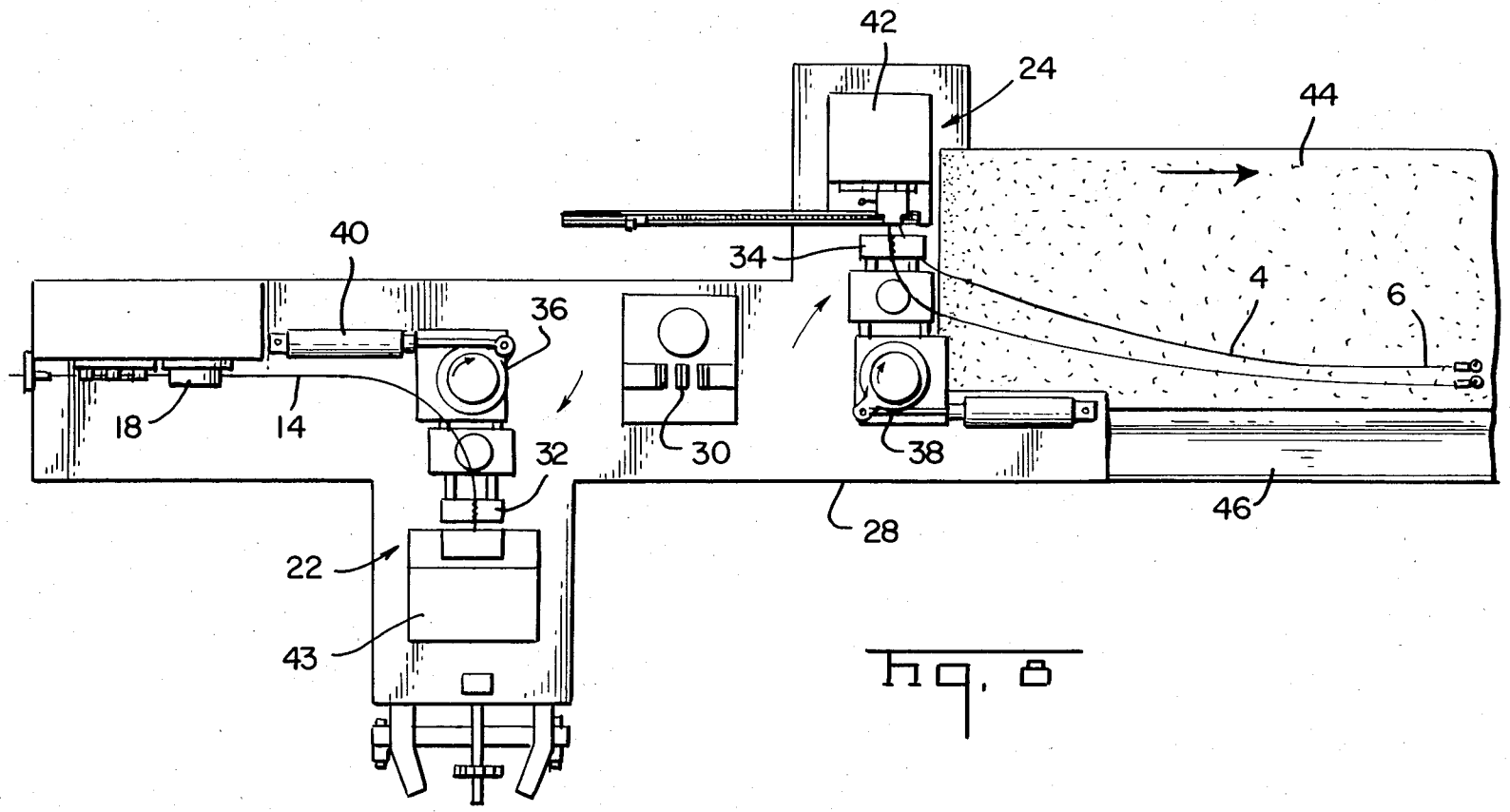
FIG. 8 is a view similar to FIG. 7 but illustrating the manner in which cut wire ends are presented to terminating or connecting stations to connect the wires to terminals.
Figure 7:
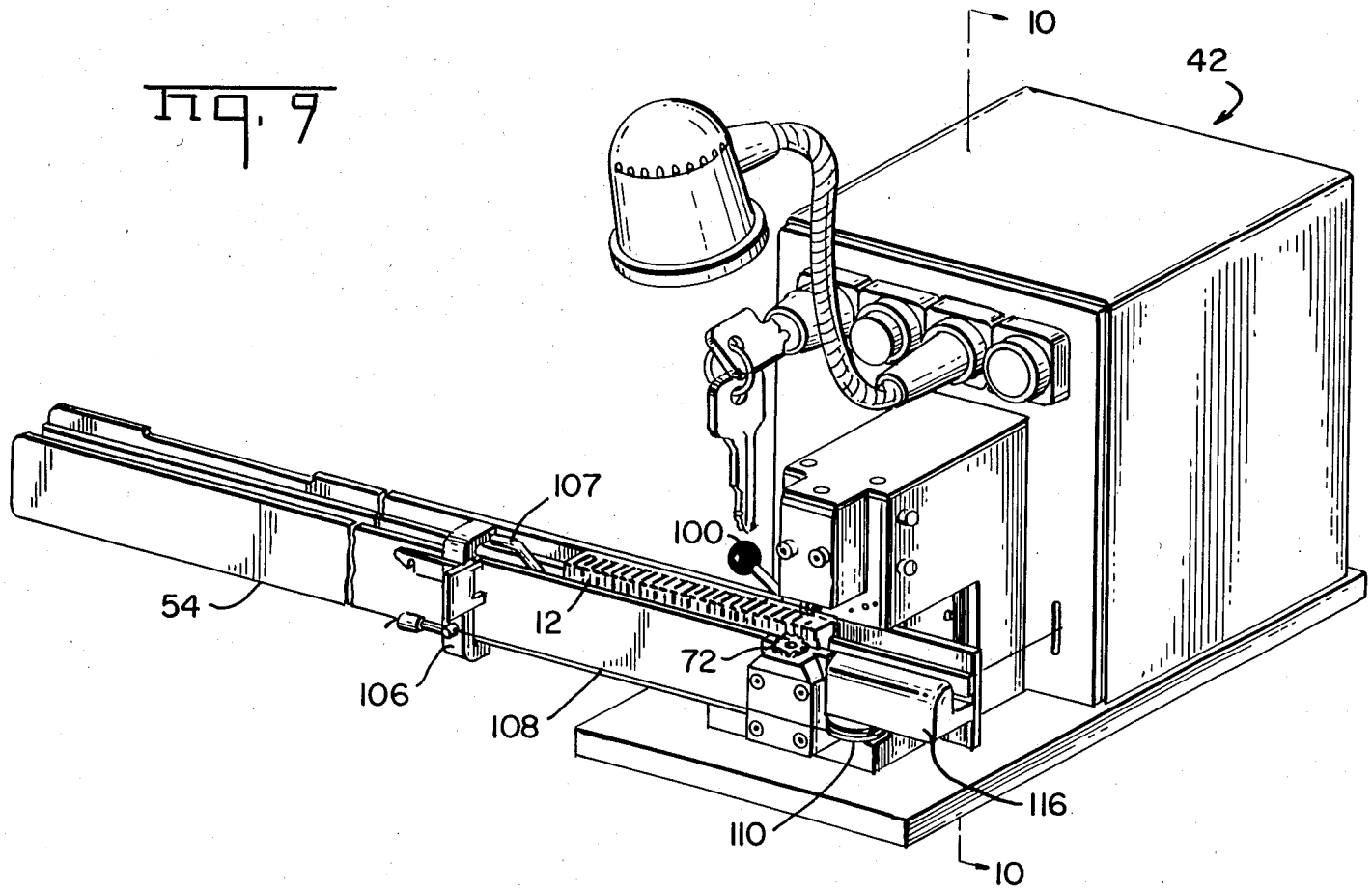

FIGS. 6–13 show a machine for practicing the invention which is of a type produced by Megomat AG Machinenfabric of Loostrasse 3, CH-8803, Ruschlikon, Switzerland. The particular machine shown in FIGS. 6–8 is a Filomat ASM 1000 model which is widely known and is commercially available. Accordingly, the known and commonly used features of this machine will be described only briefly and the modifications which are essential to the practice of the present invention will be described in detail.

The apparatus 26, FIGS. 6–8, has a supporting frame 28 which provides a surface above which the essential elements are located as shown in FIG. 7. The wire feed path is clearly shown in this figure and it is assumed that a wire 4 has been attached to a connector 12 at the second wire-connecting zone 24 and that another length of wire 14 has been fed by the feeding means 18 along the wire feed path. It will be noted that this wire 14 has a terminal on its right-hand end as viewed in FIG. 7.

The wire cutter 30 is centrally located in FIG. 7 and the upstream and downstream connecting zones, the first and second connecting zones are shown at 22 and 24.

First and second sets of normally opened and normally aligned wire clamping jaws 32, 34 are provided on the upstream side and on the downstream side of the cutting mechanism 30. The jaw assemblies 32, 34 are carried by first and second wire shifting assemblies 36, 38 which are capable of rotating in a clockwise direction 90° from the positions of FIG. 7 to the positions of FIG. 8 so that after cutting of the wires and closing of the jaws 32, 34 the cut ends of the wires will be presented to the connecting stations as shown in FIG. 8. Rotation of the shifter mechanisms or assemblies 36, 38 is carried out by pneumatic piston-cylinders as shown at 40.

A crimping press 43 is provided in the connecting zone 22 and is mounted on a wheeled support or dolly 41 so that a different press can be moved to the machine if required. A relatively wide belt conveyor 44 is provided adjacent to the wire feed path on the downstream side of the cutters and adjacent to the connecting zone 24 so that wires extending from a connector in the second connecting zone will continually be urged in the downstream direction. An applicator 42 is provided in the connecting zone 24 and is described in detail below.

Machines of the type shown in FIG. 6, and the more modern lead-making machines known to the industry, are ordinarily controlled by a microprocessor as shown at 48 which can be programmed to control all of the operations such as closure of the clamping jaws, the wire feeding step, and the rotation of the wire shifters. The wire feeding operation for example can be carried out by a wire feeding system as described in U.S. Pat. No. 3,612,369 and the feeder can be programmed to feed different lengths of wire during an operating sequence (a plurality of operating cycles) during which a single harness is produced.

The applicator 42 which connects the ends 8 of the wires 4 to the terminals in a connector 12 is shown in FIGS. 9–13 and will now be described in detail.

Figure 10:
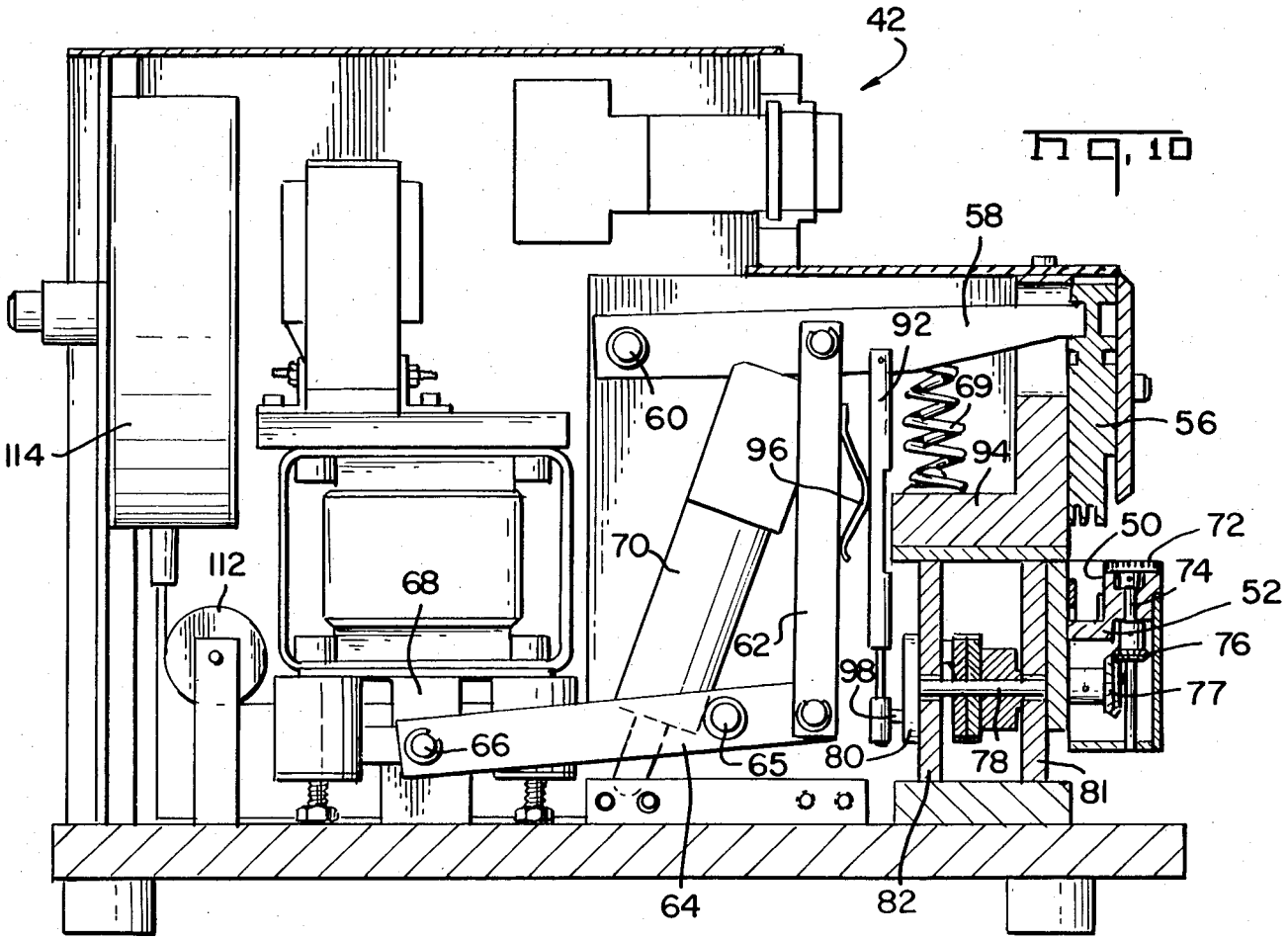
FIG. 10 is a cross-sectional view of the apparatus of FIG. 9 looking in the direction of the arrows 10—10 of FIG. 9.

The applicator has a terminating zone 50, FIGS. 10 and 11, in which the wires are presented and engaged by an inserter 56 which pushes the wires into the terminals and the connector. The terminating zone has a connector support 52 to which connectors are fed along a connector feed track in the form of an elongated extension as shown at 54. The insertion ram 56 is reciprocated by means of a lever 58 which is loosely received in an opening in the ram. The lever is pivoted at its left-hand end as shown at 60 and is pivoted intermediate its ends to a link 62. The link 62 in turn is pivoted at its lower end as viewed in FIG. 10 to a lever 64 which in turn has a pivotal connection 66 with the ram of a solenoid as shown in FIG. 10. When the solenoid is energized, the ram 68 is moved upwardly from the position of FIG. 10 and the lever 64 is swung about its intermediate pivot 65 in a clockwise direction so that the lever 58 is pulled downwardly by the link 62 thereby driving the ram 56 downwardly.

A return spring 69 is provided to bias the lever 58 upwardly and in addition, it is desirable to provide a shock absorber or the like as shown at 70 to insure that the operation of the machine will be smooth and even.

During each operating cycle, it is required that the connector 12 in the zone 50 be fed or advanced by a distance equal to the spacing between adjacent terminals in the connector housing. Such feeding is accomplished by a toothed feed wheel 72 which is mounted on a vertical shaft 74 that is coupled by bevel gears 76, 77 to a horizontal shaft 78. The horizontal shaft 78 extends through vertical frame members 81, 82 and has a bell crank 80 on its left-hand end which is substantially against the left-hand surface of the plate 82, see FIG. 13. A pin or bolt 84 extends from the bell crank 80 through an oversized opening in the plate 82 and has an escapement lever 86 on its end, see FIG. 12. The oscillating escapement lever is pivoted at 88 and has teeth which engage the teeth of escapement wheels 90 so that when the bell crank oscillates, the shaft 78 will be rotated through a slight angle by the escapement wheels or escapement gears 90. This motion is transmitted through the bevel gears 76, 77 to the feed wheel 72 which rotates through a slight angle and thereby feeds the connector which is supported on the connector support.

The bell crank 80 is oscillated during each operating cycle by an actuator bar 92 that is pivoted to the lever 58 and which extends downwardly as viewed in FIG. 10 parallel to the plate 82. The lower end of this lever engages a pin 98 on the bell crank during downward movement but it rides over the pin until it is beyond the pin. During the upward stroke of the lever 58, the actuator bar 92 engages the pin and swings the bell crank through the required angle. Such movement of the actuator lever 92 is permitted by virtue of the fact that the actuator 92 can swing leftwardly through a slight clockwise arc from the position shown in FIG. 10. The actuator 92 is biased to the position of FIG. 10 by a leaf spring 96 which is secured to the link 62. It will be understood that the lower end of the actuator 92 must be contoured to bring about the desired effect of riding over the pin 98 and then engaging the pin during its upward movement. After the actuator has moved upwardly for a portion of its stroke, it disengages itself from the pin by swinging leftwardly as a result of the resistance encountered and it again rides over the pin 98. The escapement lever 86 is biased in an anti-clockwise direction as viewed in FIG. 12 by a spring 87. After the actuator rod is moved upwardly and is disengaged from the pin 98, the spring causes the lever and the shaft to rotate and the bell crank 80 is swung through a slight clockwise arc as viewed in FIG. 13.

It is desirable to provide a manually actuated indexing lever 100 which is pivoted at 102 and which has a lower end 104 which also is engageable with the pin 98. It will be apparent from FIG. 13 that the bell crank 80 can be oscillated and the indexing wheel indexed to feed the connectors by simply swinging the lever 100 through a slight clockwise arc. This feature is desirable to provide for the possibility that connectors must be fed through the machine during adjustment or for other reasons.

The stack of connectors 12 in the feed track 54 is advanced towards the connector support in the applicator 42 by means of sliding member 106 which is mounted on the support 54. This slide member has an arm 107 which is against the end connector in the stack in the feed track. The slider is resiliently pulled rightwardly as viewed in FIG. 9 by a cord 108 which extends around pulleys 110, 112 to a conventional cable retractor device 114 of the type used to support a tool or the like and which is commonly available. Thus when the wheel 72 rotates and advancing the connector in the terminating zone by a distance equal to the spacing between adjacent terminals in the connector, all of the connectors in the stack in the feed track are pushed by an equal amount by the finger 107 on the slider 106. In other words, the connectors in the stack follow the leading connector.

After wires have been connected to all of the terminals in a connector, it moves across an end portion 116 of the guide track and is ejected. Upon ejection, it will fall on the conveyor shown at 44 in FIG. 7. Preferably, a trough is also provided as shown at 46 to collect the finished harnesses.

It will be apparent from the foregoing that known types of lead-making machines can be adapted, with a suitable applicator 44, to practice the method of the invention to produce harnesses of the type shown at 2 in FIG. 5. Moreover, any of the commonly used lead-making machines can thus be employed either as lead makers to produce individual wires having terminals on their ends or as harness-making machines. This advantage is of particular importance to manufacturers who have a need for an automatic harness making machine but whose requirements are not sufficient to justify a specialized harness-making machine of the type shown in U.S. Pat. No. 4,136,440.

In the practice of the invention, a complete operating cycle of feeding wire, cutting the wire and shifting or moving the cut ends, as shown in FIGS. 1–5, is required for each wire inserted into the multi-contact electrical connector. THis requirement may appear to place the invention at a disadvantage as compared to machines as shown in U.S. Pat. No. 4,136,440 which connect all of the wires to the terminals in the connector in one operating cycle. However, it must be understood that a single operating cycle of the machine described in U.S. Pat. No. 4,136,440 requires a greater time interval than a single operating cycle for the practice of the present invention. Under some circumstances, therefore, harnesses can be manufactured by the method of the present invention at the same rate as by the machine of U.S. Pat. No. 4,136,440.

What is claimed is:

1. The method of manufacturing an electrical harness of the type comprising a plurality of discrete wires, each wire having a first end and a second end, the second end of each wire being connected to a terminal in a multi-contact electrical connector which has a plurality of terminals therein in side-by-side relationship in a row, the method comprising the steps of:

feeding wire from an endless source along a wire feed path, cutting the wire in a cutting zone to produce a wire lead and first and second wire ends, the first end being the cut end of the wire extending from the source, the second end being the cut end of the lead, moving the second end laterally of the feed path to a second wire connecting zone, connecting the second end to one terminal in a multi-contact electrical connector in the second connecting zone, and repeating the feeding, cutting, moving, and connecting steps until wires have been connected to all of the terminals in the multi-contact connector in the second connecting zone.

2. The method of manufacturing an electrical harness as set forth in claim 1 characterized in that after the cutting step, the first end is moved laterally of the feed path to a first connecting zone, a discrete terminal is connected to the first end, and the first end is then moved laterally back to the feed path.

3. The method set forth in claim 2 characterized in that the second ends of the wires are connected to terminals in the multi-contact connector by moving the second ends into wire-receiving slots in the terminals in the connector.

4. The method set forth in either of claims 1 or 3 characterized by the step of feeding a succession of connectors along a connector feed path which extends into the second connecting zone by an amount equal to the distance between adjacent terminals in a connector during each operating cycle.

5. Apparatus for connecting wires to terminals, the apparatus being of the type comprising a wire feeder for intermittently feeding wire from an endless source along a wire feed path, an upstream wire clamp and a downstream wire clamp on the feed path, the upstream clamp being upstream, relative to the direction of wire feed, from the downstream clamp, the clamps being normally open and in aligned positions so that the wire can be fed through the clamps, the clamps being closable onto the wire upon the cessation of wire feeding, a wire cutter between the wire clamps so that the fed wire can be cut and the upstream and downstream clamps will be in clamping engagement with an upstream wire end and a downstream wire respectively, an upstream wire connecting station and a downstream wire connecting station, the wire connecting stations being beside the wire feed path and proximate to the upstream and downstream wire clamps respectively, the wire clamps being shiftable by clamp shifters between their normal aligned positions and nonaligned positions in which the upstream and downstream wire ends are presented to the upstream and downstream wire connecting stations respective, the apparatus being an integrated machine having a supporting frame with the wire feeder, the wire clamps, the wire cutter and the clamp shifters all being disposed on the supporting frame and being clustered in an operating zone through which the wire feed path extends, the apparatus being characterized in that:

an applicator is provided at the downstream wire connecting station for inserting wires, one at a time, into wire-receiving slots in terminals which are in side-by-side relationship in a row in a multi-contact electrical connector, the applicator having an insertion zone, a connector support in the insertion zone, an insertion ram which is reciprocable towards and away from a terminal in a connector on the connector support, and a connector indexer for advancing a connector on the support by a distance equal to the spacing between adjacent terminals in the connector, actuating means are provided for sequentially actuating the wire feeder, closing the wire clamps onto the fed wire, actuating the wire cutter, actuating the wire shifters to shift the wire clamps from their aligned positions to their nonaligned positions, reciprocating the insertion ram towards and away from a connector on the connector support, opening the downstream wire clamp, again actuating the wire shifters to thereby return the wire clamps to their aligned positions, and opening the upstream wire clamp, whereby during each operating cycle of the apparatus, a downstream wire end is inserted to one of the terminals in a connector on the connector support, and after a series of operating cycles, severed wires are connected to all of the terminals in the connector.

6. Apparatus as set forth in claim 5 characterized in that a terminal crimping machine is provided at the upstream wire connecting station for crimping a terminal onto the upstream wire end during each operating cycle.

7. Apparatus as set forth in claim 6 characterized in that a belt conveyer extends from the downstream wire connecting station whereby wires connected to the terminals in the connector in the connector support are maintained in parallel relationship to each other.

* * * * *